United States Patent [19]

Malcolm

[11] 4,346,848

[45] Aug. 31, 1982

[54] NOZZLE WITH ORIFICE PLATE INSERT

[76] Inventor: William R. Malcolm, 2281 N. Piedra Rd., Sanger, Calif. 93657

[21] Appl. No.: 201,708

[22] Filed: Oct. 29, 1980

Related U.S. Application Data

[63] Continuation of Ser. No. 74,722, Sep. 12, 1979, abandoned, which is a continuation of Ser. No. 930,904, Aug. 4, 1978, abandoned.

[51] Int. Cl.[3] ..... B05B 1/02

[52] U.S. Cl. ..... 239/596; 239/601

[58] Field of Search ..... 239/596, 597, 599, 601; 137/802; 222/575

[56] References Cited

U.S. PATENT DOCUMENTS

| | | | |
|---|---|---|---|
| Re. 19,913 | 3/1936 | Paradise | 239/601 X |
| 621,480 | 3/1899 | Stevens | 239/601 |
| 1,276,245 | 8/1918 | Millard et al. | 239/596 |
| 1,445,049 | 2/1923 | Stuart | 239/601 |
| 1,534,546 | 4/1925 | Ross | 239/601 X |
| 1,753,443 | 4/1930 | Murray | 239/597 |
| 1,829,878 | 11/1931 | Sims et al. | 239/596 |
| 2,127,883 | 8/1938 | Norton | 239/597 X |
| 2,284,443 | 5/1942 | Paradise | 239/596 |
| 2,647,014 | 7/1953 | Edwards | 239/601 X |
| 2,778,687 | 1/1957 | Hegstad | 239/601 |
| 3,149,784 | 9/1964 | Skidgel | 239/601 X |
| 3,625,437 | 12/1971 | Garrigou | 239/596 X |
| 3,737,108 | 6/1973 | Stumphauzer et al. | 239/601 X |
| 4,216,913 | 8/1980 | Troup | 239/601 X |

OTHER PUBLICATIONS p. 80, Rain Bird 1974 Irrigation Equipment Catalog.

*Primary Examiner*—Johnny D. Cherry
*Attorney, Agent, or Firm*—Huebner & Worrel

[57] ABSTRACT

A sprinkler has an orifice through an orifice plate. The periphery of the orifice is preferably not circular; it has at least one corner formed by the intersection of adjacent portions of the periphery. The nozzle plate is preferably domed and mounted concave with respect to the source of the fluid. The orifice may be a number of different shapes including various polygons, tear-shaped or generally circular with notches mounted in the periphery. The orifice may be eccentrically mounted through the dome of the plate.

6 Claims, 11 Drawing Figures

FIG. 1
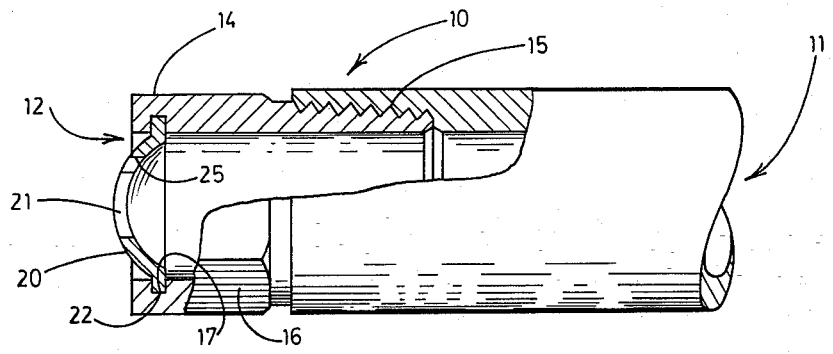
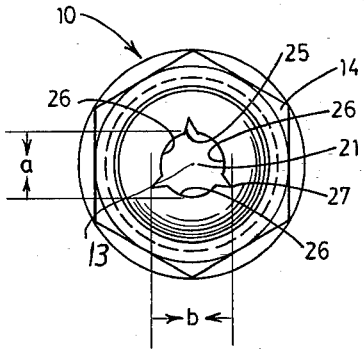
FIG. 2
FIG. 3
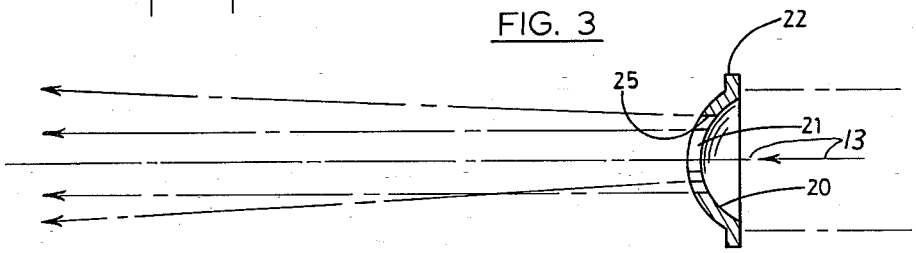
FIG. 4
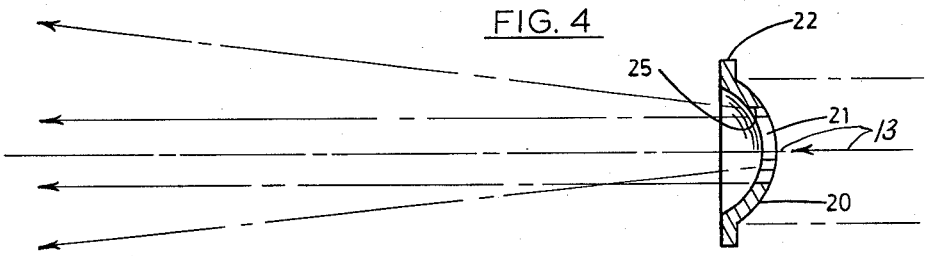
FIG. 5
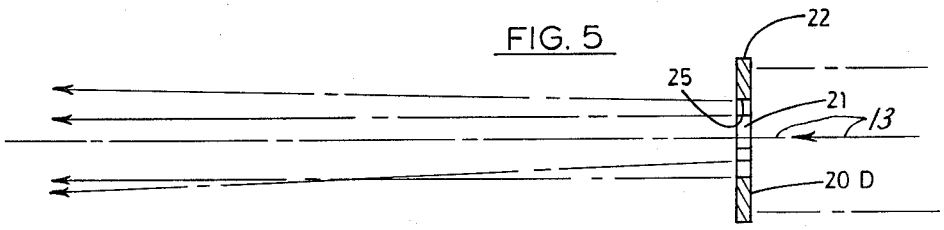

NOZZLE WITH ORIFICE PLATE INSERT

This is a continuation application of application Ser. No. 074,722 filed Sept. 12, 1979, now abandoned, which in turn is a continuation application of application Ser. No. 930,904, filed Aug. 4, 1978, now abandoned.

BACKGROUND OF THE INVENTION

This invention relates primarily to sprinklers especially those for agricultural uses.

The effectiveness of sprinklers can be judged by a number of different factors. The first factor is the water distribution pattern. Ideally, the amount of water per unit area would be directly proportional to the distance from the sprinkler. For example, an ideal sprinkler may provide 2 liters of water per given area at the sprinkler, 1.5 liters at 10 feet (3 m) from the sprinkler, 1 liter at 20 feet (6 m), 0.5 liters at 30 feet (9 m) and no water at 40 feet (12 m), the falloff in the amount of water would be relatively constant over distance. Then, a second sprinkler could be mounted approximately 40 feet (12 m) from the first with the same distribution pattern so that the second sprinkler would add 2 liters of water 40 feet (12 m) from the first sprinkler, 1.5 liters at 30 feet (9 m) from the first sprinkler, 1 liter at 20 feet (6 m), 0.5 liters at 10 feet (3 m) and no additional water at the first sprinkler. Adding the water that both sprinklers provide yields 2 liters per given area over the entire field, and even watering is ideal.

Metric conversions of inches, feet and pounds are approximations and are frequently rounded off.

Unfortunately, prior art sprinklers have large amounts of variability in their distribution pattern. There are peaks and there are depressions in the distribution curve. Certain nozzles may have extremely low distribution in the center of their distance. If the low point coincides with the low point of an adjacent sprinkler, certain field areas will receive less than the necessary amount of water. Likewise, other areas may receive too much water.

One of the problems with prior art nozzles is in causing the fluid flow to break from a narrow stream, and one of the objects of the present invention is to disclose and provide a nozzle which does disburse the main stream.

Some prior art nozzles attempt to break the main stream by use of elevated pressures. For example, it is not uncommon to run agricultural sprinklers at 60 to 70 psi (4218–4920 g/cm$^2$). High pressures create two major problems. First, there is a substantially larger energy consumption in high pressure systems than in lower pressure ones. The cost of power for irrigation is not insubstantial. For example, in California's Central Valley, large farms spend over one million dollars for power for irrigation. Much of the power is obtained from hydro generators driven by the irrigation water itself as it flows from the snowpack in the Sierra Nevada Mountains. That power could be used elsewhere, however, if it were not necessary for agricultural uses.

A second problem deals with droplet size. It is believed that in the high pressure systems, an extremely small droplet size is obtained. Therefore, during sprinkling more water is vaporized and less falls on the ground. This wastes precious water by itself, but the effects of such wastefullness are compounded. Because less water reaches the field in a given period of time, the length of watering must be increased often into the high temperature, low humidity daytime, climatic conditions that are relatively common in the western United States. Under these conditions, much of the irrigation water evaporates either from the sprinkler or as it is lying on the ground before it can penetrate the soil. Therefore, it is an object of the present invention to disclose and provide a sprinkling system that can operate under lower pressures so that droplet size can be increased, distribution of water over time can be increased, and pressure and power consumption can be reduced.

The nozzle of the present invention is designed to operate at approximately 30 psi (2109 g/cm$^2$), and as described in more detail hereinafter, it distributes more water in a more even distribution than a standard one delivers at its higher pressure.

The orifice of this sprinkler is larger than the diameter of nozzles of standard sprinklers, but because of the decreased efficiency of orifices relative to nozzles, excessive amounts of water are not delivered. The larger orifice passes debris that would otherwise clog smaller orifices or nozzles. Also, the buildup of deposits of salts is less critical in a large nozzle than in a small one. Therefore, it is an object of the present invention to disclose and provide a nozzle which can utilize a larger orifice for prevention of clogs from debris.

Another object of the present invention is to disclose and provide a low cost nozzle. In some prior art nozzles, the housing and orifice plate are one piece of material. It is advantageous to make the orifice plate of wear resistant material such as stainless steel or carbide for resistance of wear from water passing through the orifice. However, there is no necessity that the orifice housing be of wear resistant material; to do so increases the cost. It is beneficial, therefore, to make the orifice housing out of low cost brass or plastic.

The present invention also solves additional objects that will become evident in the foregoing specification.

SUMMARY OF THE INVENTION

The present invention yields improved water distribution with decreased pressure and a larger orifice by having the periphery of the orifice have at least one corner. In one embodiment, the orifice is a polygon, and in other embodiments, the orifice is circular with spaced notches extending outward from the circle. A tear-shaped orifice is also an embodiment. The orifice plate may also be domed, preferably concave with respect to the source of the fluid. Merely mounting an orifice off the dome's axis improves water distribution patterns.

In order to decrease costs, the orifice plate may be formed of a different material than the nozzle housing and the nozzle housing has means for mounting the orifice plate in a press fit relationship.

BRIEF DESCRIPTION OF THE DRAWINGS

FIG. 1 is a fragmentary side elevation of a portion of a sprinkler mounting the nozzle with orifice plate insert of the present invention.

FIG. 2 is an end view of the portion of the sprinkler of FIG. 1.

FIGS. 3 and 4 show the water distribution pattern of the orifice plate of FIG. 1. In FIG. 3, the orifice plate is mounted concave with respect to the source of fluid, and in FIG. 4, it is convex with respect to the source of fluid.

In FIG. 5, a modified embodiment of the orifice plate of the present invention is shown with the orifice plate being flat rather than domed.

In FIGS. 6 and 7, the orifice is triangularly shaped; in FIGS. 8 and 9, the orifice is a square; and in FIGS. 10 and 11, the orifice is tear-shaped.

DETAILED DESCRIPTION OF THE PREFERRED EMBODIMENT

Figure 6:
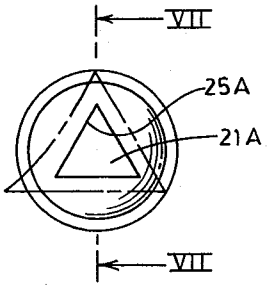
FIGS. 6, 8 and 10 show modifications of the orifice of the nozzle plate of the present invention.

FIG. 1 shows the discharge end 10 of a sprinkler, especially of impulse rotating sprinklers. Impulse rotating sprinklers are old both in agricultural and residential use. Typically, the orifice points at an angle upward, and the discharge end rotates in a circle. Depending on the wind, the sprinkler irrigates a somewhat circular patch of ground.

Although the orifice of the present invention is designed primarily for impulse rotating sprinklers, the orifice has applications of other types of sprinklers, and it also may be used for distribution of other fluids. The concept applies to many applications of spraying fluids.

The discharge end 10 of the sprinkler delivers fluid from a source of fluid from the upstream end 11 to the downstream end 12 in a fluid stream along a predetermined path substantially concentric to the longitudinal axis 13 of the substantially cylindrical discharge end 10 of the sprinkler as shown in FIGS. 1, 2, and 3. Thus, of course, the longitudinal axis of the fluid stream and of the discharge end 10 are coincident or, in otherwords, the same. A nozzle or orifice housing 14 is threaded into discharge end 10 of mating threads 15, and hex end 16 of orifice housing 14 facilitates threading and tightening orifice housing 14 into discharge end 10 of the sprinkler. Typically, hex end 16 is $\frac{3}{8}$ inch (0.95 cm).

A circular dish or orifice plate 20 with orifice 21 therethrough is mounted in the downstream end of orifice housing 14. FIG. 1 shows that orifice plate 20 is a part separate from orifice housing 14. Orifice plate 20 is preferably formed of a material that is resistant to rust or corrosion and to the wear of the fluid passing at high velocity along the walls of the orifice. Stainless steel or carbide are chosen for orifice plate 20. Because the orifice housing is subjected to less wear, low cost brass or plastic could be used for it. Orifice plate 20 is press fit or staked into orifice housing 14 by means of the cooperation of groove 17 of the orifice housing and flange 22 extending around the periphery of orifice plate 20. Thus, the orifice plate is mounted on the orifice housing within the groove 17, as shown in FIGS. 1 and 2.

The shape of the orifice is different from prior art orifices. The periphery 25 of the orifice has at least one corner formed by the intersection of adjacent portions of the periphery of the orifice. In the exemplary embodiment of FIG. 2, the periphery of the orifice has circular portions 26. At least one notch (in the case of FIG. 2 in the exemplary embodiment, there are three notches 27) extends outward from circular portion 26. These notches are the corners spoken of above.

The shape of the orifice of the present invention gives substantially improved results over round orifices of the prior art. Fluid leaving a round orifice tends to flow in such a manner that substantially all segments of the stream are parallel to the flow. Of course an entirely parallel flow will yield a donut pattern of water distribution a certain distance from the sprinkler. Therefore, it is necessary to destroy the parallel flow. In the prior art, this was done by increasing the pressure which yields a corresponding increase in velocity through the orifice. The increased velocity increases the Reynolds Number causing turbulent flow and destroying the laminar flow. However, it has been found that this technique decreases droplet size causing an increase in the amount of water vaporized which wastes water.

The shape of orifice 21 and of the orifice plate 20 both contribute to breaking the stream of fluid. In the exemplary embodiment of FIG. 2, which appears to be the best mode, notches 27 help destroy the laminar nature of the flow by breaking a portion of the stream away from the center. As will be discussed below, orifice plate 20 is in the shape of a dome, and that configuration also helps to break the stream of water.

In the preferred exemplary embodiment of FIG. 2, where the nozzle plate is approximately 0.31 inches (0.79 cm) in diameter, there are three notches 27 spaced approximately 120° apart and substantially symmetrical to the longitudinal axis of the discharge end 10 of the sprinkler. Each notch has a width of about between 0.010 and 0.014 inches (0.025–0.036 cm). Diameter a is 0.109 in (0.277 cm), and diameter b is about 0.160 in 0.406 cm). The thickness of the metal is approximately 0.019 in (0.048 cm). The angle that the portions of the periphery of the orifice make to each other at the apex of each notch 27 is approximately 60°. Thus, in the preferred exemplary embodiment of FIG. 2, each notch is between 0.009 and 0.012 in (0.022 and 0.031 cm) in length.

Figure 7:
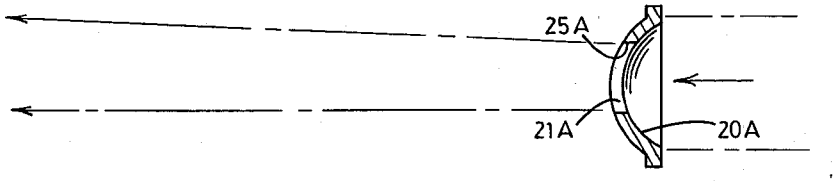
FIGS. 7, 9 and 11 are sectional views of the nozzle plates, FIG. 7 being taken through plane VII—VII of FIG. 6, FIG. 9 being taken through plane IX—IX of FIG. 8, and FIG. 11 being taken through plane XI—XI of FIG. 10.
Figure 8:
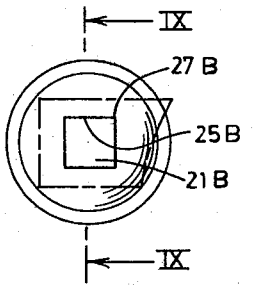
Figure 9:
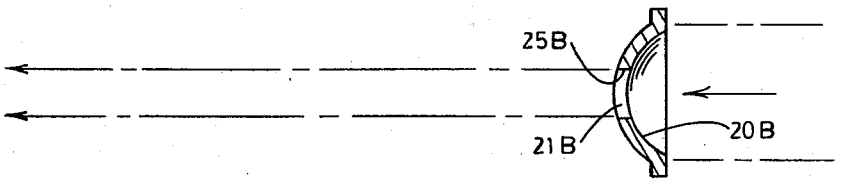

In other exemplary embodiments, the orifice may be in a shape of a polygon. For example, in FIGS. 6 and 7, orifice 21A is in the shape of a triangle, and in FIG. 8, orifice 21B is in the shape of a square. Polygons have corners which break the fluid flow. Higher degree polygons would also be successful but there is a gradual decrease in effectiveness as the number of sides increase and the polygon approaches a circle.

Orifice plate 20 is in the shape of a dome. The domed nature of the orifice plate improves water distribution substantially. In the preferred exemplary embodiment, particularly FIGS. 1 and 3, nozzle or orifice plate 20 has a dome that is a portion of a sphere, but other curvatures and conical shapes would also work. In the exemplary embodiment, the radius of the sphere is approximately $\frac{1}{8}$ in (0.32 cm).

Although the shape of the orifice contributes to water distribution, the dome improves it. It is believed that the dome shape directs the periphery of the stream farther away from the main stream. If the periphery is too close, the low pressure created by the high velocity stream tends to draw the periphery of the stream back into the main stream. This effect is diminished if the periphery is drawn farther away.

It has been found that mounting the orifice plate such that it is concave with respect to the source of fluid (FIGS. 1 and 3) yields superior results over mounting the dome convex with respect to the source of fluid (FIG. 4). However, the FIG. 4 configuration yields slightly better results than the flat orifice plate of FIG. 5.

Figure 10:
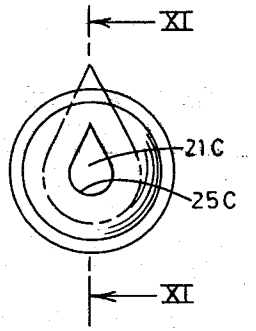
Figure 11:
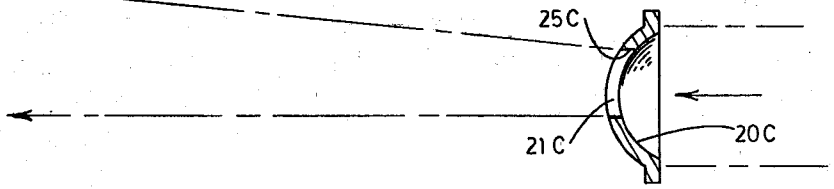

Mounting the orifice eccentric to the axes of orifice plate 20 also modifies the distribution pattern and in many instances improves it. One such eccentric orifice is shown in FIG. 10 wherein orifice 21C is in the shape of a tear. Other modifications could also be made. For example, square orifice 21B (FIG. 8) may have a notch 27B extending from one corner of the square periphery 25B.

Tests of the nozzle have proved successful. For example, one fairly standard way of testing distributions of water is to place containers every five feet (1.5 m) from the sprinkler. A second sprinkler and its containers are also set up outside of the distribution pattern of the first sprinkler. The containers for both sprinklers are in straight lines in the same direction. In one test, a standard nozzle with a round orifice was tested against the nozzle with an orifice plate shown in FIGS. 2 and 3. The test lasted four hours and the sprinkler rotated every 20 to 22 seconds. The wind ranged between 2 and 5 mph (0.89–1.34 m/sec). The temperature ranged from 86° F. (30° C.) to 92° F. (33° C.).

In the chart below, orifice a is a standard nozzle operated at 50 psi (3515 g/sq.cm). Nozzle b is the preferred orifice shown in the specification. It was operated at 30 psi (2110 g/sq.cm).

In the chart below, the amount of water collected at each location is in milliliters. In comparing nozzles a and b, it can easily be seen that the falloff of water distribution from nozzle a is substantially greater than for nozzle b. From 10 feet (3 m) to approximately 35 feet (10 m) the decrease in water is relatively constant. In nozzle a on the other hand, the amount of water falls off rapidly and substantially no water is delivered between 20 and 25 feet (6–7.6 m) from the sprinkler.

It is estimated that nozzle b is approximately 40 percent greater in irrigation efficiency than nozzle a and it also uses approximately 40 percent of the power that nozzle a uses.

Tests with nozzles e through f should not be compared to nozzles a and b because the test conditions were different. However, in nozzle c, a standard nozzle, using 40 psi (2810 g/sq.cm), a pattern having a relatively rapid falloff to 20 feet (6 m) was measured with a relatively rapid upswing from 20 to 30 feet (6–9.1 m). If such sprinklers are used in the field, areas 20 feet (6 m) from the sprinkler would be underwatered while areas 30 feet (9.1 m) might be overwatered. Nozzles d, e and f all are domed with slots.

In the second test, sprinklers with nozzles c and d were operated at 50 to 35 psi (3515 and 2460 g/sq.cm). Nozzle c is standard, and nozzle d includes the orifice plate of the present invention.

In the third test, sprinklers with nozzle g, a standard nozzle, operated at 50 psi (3515 g/sq.cm) is compared with nozzle f, a nozzle having an orifice plate of the present invention operated at 35 psi (2460 g/sq.cm). The diameter of the orifice is modified from the previous test.

In the last test, nozzle g, a standard nozzle, is operated at 50 psi (3515 g/sq.cm) and nozzle h, with the present orifice plate is operated at 35 psi (2460 g/sq.cm).

| | TEST RESULTS | | | | | | | | | |
|---|---|---|---|---|---|---|---|---|---|---|
| | FEET | | | | | | | | | |
| | 2.5 | 5 | 10 | 15 | 20 | 25 | 30 | 35 | 40 | 45 |
| | METERS | | | | | | | | | |
| NOZZLE | .8 | 1.5 | 3.0 | 4.6 | 6.0 | 7.6 | 9.1 | 10.7 | 12.2 | 13.7 |
| a | 21 | 17 | 9 | 6 | 0 | 0 | 4 | T | 0 | 0 |
| b | 18 | 15 | 21 | 15 | 12 | 9 | 6 | T | 0 | 0 |
| c | 18 | 18 | 9 | 3 | 6 | 0 | 3 | T | 0 | 0 |
| d | 12 | 15 | 21 | 21 | 18 | 17 | 14 | 4 | T | 0 |

-continued

| | TEST RESULTS | | | | | | | | | |
|---|---|---|---|---|---|---|---|---|---|---|
| | FEET | | | | | | | | | |
| | 2.5 | 5 | 10 | 15 | 20 | 25 | 30 | 35 | 40 | 45 |
| | METERS | | | | | | | | | |
| NOZZLE | .8 | 1.5 | 3.0 | 4.6 | 6.0 | 7.6 | 9.1 | 10.7 | 12.2 | 13.7 |
| e | 6 | 8 | 8 | 14 | 14 | 12 | 12 | 10 | 2 | 0 |
| f | 12 | 18 | 24 | 22 | 20 | 18 | 16 | 10 | 4 | T |
| g | 36 | 24 | 12 | 8 | 8 | 9 | 18 | 12 | 3 | T |
| h | 37 | 33 | 21 | 24 | 22 | 20 | 18 | 16 | 5 | T |

It should be recognized that various modifications could be made within the scope of the invention. Without enumerating all of them, the number of slots could be modified, the depth and width of the slots could be changed, the curvature of the dome could also be modified, and the thickness of the metal for the orifice plates could be changed. These modifications, however, are considered to be within the scope of the invention. Likewise, although the discussion has dealt primarily with sprinklers, the invention has applicability to other fluid distribution systems.

I claim:

1. An orifice plate for a sprinkler having a nozzle for release of a fluid stream from the sprinkler along a predetermined substantially straight path, the orifice plate comprising a member having a concave surface, a periphery dimensioned to permit the member to be mounted on the nozzle transversely of the predetermined path with said concave surface facing inwardly of the sprinkler and an orifice extending through the member in a position to be substantially centrally disposed with respect to the predetermined path when the member is mounted on the nozzle, the orifice having a periphery with at least three angular corners arranged in a pattern extending radially away from and substantially symmetrical to said path to break away outer portions of the fluid stream from the main body of the fluid stream for precipitation nearer to the sprinkler than the fluid of said main body of the fluid stream without substantially reducing the range of the sprinkler.

2. The orifice plate of claim 1 wherein adjacent corners of the periphery of the orifice are individually interconnected by curved portions of the periphery.

3. The orifice plate of claim 1 wherein the periphery of the orifice is substantially in the form of a polygon.

4. The orifice plate of claim 1 wherein the periphery of the orifice has not more than four corners.

5. An orifice plate for an orifice housing of a sprinkler adapted to release a fluid stream through the housing substantially concentric to a longitudinal axis, the orifice plate comprising a circular disk having a concave surface and an opposite convex surface and bounded by a peripheral flange dimensioned for fitted mounting on the orifice housing of the sprinkler transversely of the longitudinal axis of the fluid stream with said concave surface of the disk facing inwardly of the orifice housing, and not more than one orifice extending through the disk and the concave and convex surfaces thereof in a position to be substantially aligned with the longitudinal axis of the fluid stream when said disk is mounted on the orifice housing and said orifice having a periphery with at least three angular corners and not more than four angular corners arranged in a pattern extending within the disk radially away from and substantially symmetrical to said longitudinal axis of the fluid stream and said angular corners being of sufficient depth to break away outer portions of the fluid stream while leaving the central portion of the fluid stream substantially undisturbed.

6. The orifice plate of claim 5 wherein the periphery of the orifice includes portions between adjacent corners thereof which define a substantially circular configuration substantially concentric to said longitudinal axis.

* * * * *

UNITED STATES PATENT AND TRADEMARK OFFICE

CERTIFICATE OF CORRECTION

PATENT NO. : 4,346,848
DATED : August 31, 1982
INVENTOR(S) : William R. Malcolm

It is certified that error appears in the above-identified patent and that said Letters Patent are hereby corrected as shown below:

Column 3, Line 41, delete "dish" and substitute ---disk---;

Column 4, Line 66, delete "axes" and substitute ---axis---.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*